US006637073B2

(12) United States Patent
Kincaid

(10) Patent No.: US 6,637,073 B2
(45) **Date of Patent: *Oct. 28, 2003**

(54) HINGE COVER

(76) Inventor: Milo Kincaid, 266 NW. 5th St., Prineville, OR (US) 97754

( * ) Notice: Subject to any disclaimer, the term of this patent is extended or adjusted under 35 U.S.C. 154(b) by 0 days.

This patent is subject to a terminal disclaimer.

(21) Appl. No.: 09/909,167

(22) Filed: Jul. 16, 2001

(65) Prior Publication Data

US 2003/0009850 A1 Jan. 16, 2003

Related U.S. Application Data

(63) Continuation-in-part of application No. 09/745,596, filed on Dec. 21, 2000, now Pat. No. 6,557,210.

(51) Int. Cl.[7] ..... E05D 11/00
(52) U.S. Cl. ..... 16/250; 16/251; 16/DIG. 2
(58) Field of Search ..... 16/250, 251, DIG. 2; 18/504, 505; 118/504, 505

(56) References Cited

U.S. PATENT DOCUMENTS

| | | | | | |
|---|---|---|---|---|---|
| 4,195,590 | A | * | 4/1980 | Herrington | 118/505 |
| 4,570,291 | A | | 2/1986 | Smith et al. | |
| 4,656,058 | A | * | 4/1987 | Stark | 427/282 |
| 4,691,409 | A | | 9/1987 | Torgerson et al. | |
| 4,750,238 | A | * | 6/1988 | Rock et al. | 16/250 |
| 4,796,330 | A | | 1/1989 | Ziegler | |
| 4,802,259 | A | * | 2/1989 | Geslewitz | 16/251 |
| 5,056,191 | A | | 10/1991 | Love | |
| 5,056,192 | A | * | 10/1991 | Grass | 16/251 |
| 5,224,240 | A | * | 7/1993 | Smith et al. | 16/251 |
| 5,432,298 | A | * | 7/1995 | Thompson | 174/67 |
| D361,021 | S | | 8/1995 | Harper | |
| D362,602 | S | | 9/1995 | Kusler | |
| 6,007,172 | A | | 12/1999 | Shufelt et al. | |
| 6,165,269 | A | * | 12/2000 | Kathe | 118/505 |
| 6,248,173 | B1 | * | 6/2001 | Dixon | 118/505 |
| 6,317,925 | B1 | * | 11/2001 | Pietryga et al. | 16/250 |

FOREIGN PATENT DOCUMENTS

| | | | | |
|---|---|---|---|---|
| WO | WO 9015912 | * | 12/1990 | 16/250 |

* cited by examiner

*Primary Examiner*—Anthony Knight
*Assistant Examiner*—Doug Hutton
(74) *Attorney, Agent, or Firm*—Glenn C. Brown

(57) ABSTRACT

A cover for temporarily covering a hinge, the hinge having a first portion for mounting on a fixed surface and a second portion for mounting on a door, the second portion hingedly attached to the first portion, the hinge having a first position wherein the first and second portions are perpendicular to one another, and a second position wherein the first and second portions are parallel to one another. The hinge cover includes a first member having a raised central channel, first left and right flanges, and a first vertical flange for resiliently engaging at least one vertical surface of the first hinge portion. A second member includes a raised channel, second left and right flanges, and a second vertical flange for resiliently engaging at least one vertical surface of the second hinge portion, the second body portion raised channel adapted for receiving a portion of the first member raised central channel.

9 Claims, 4 Drawing Sheets

Fig. 1
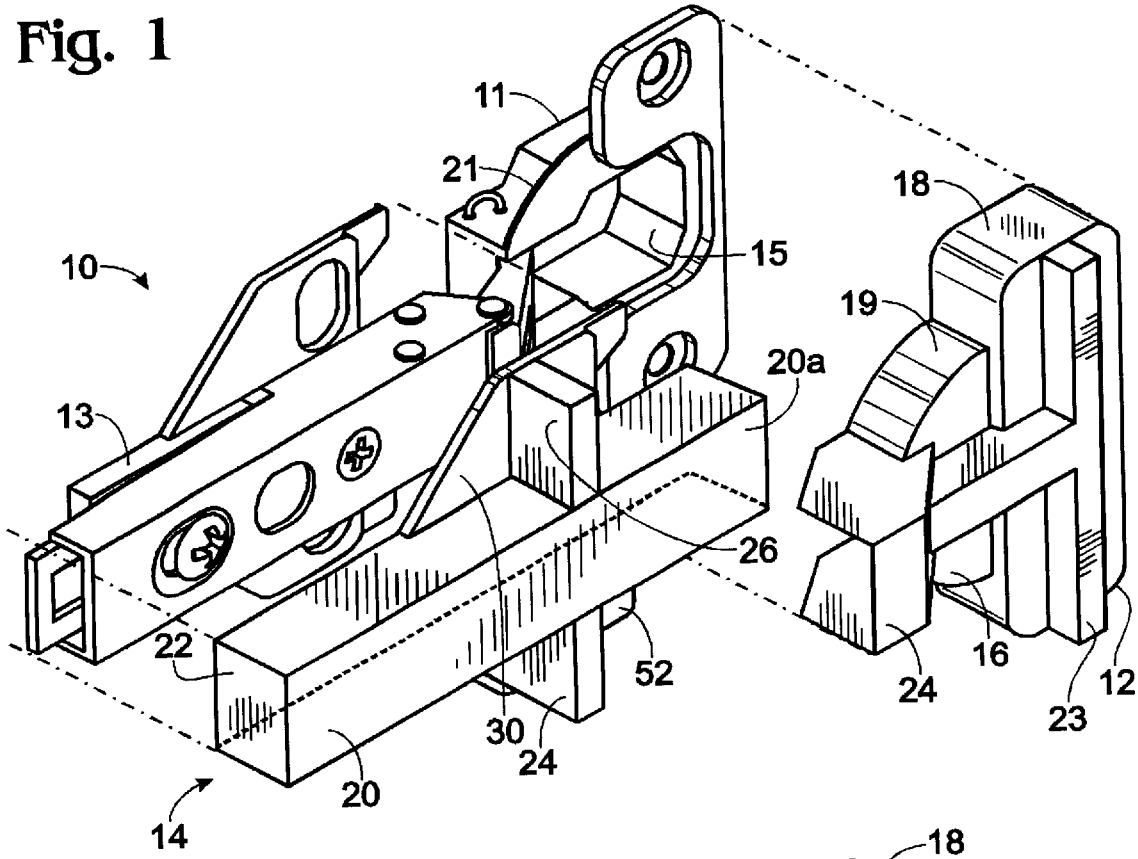
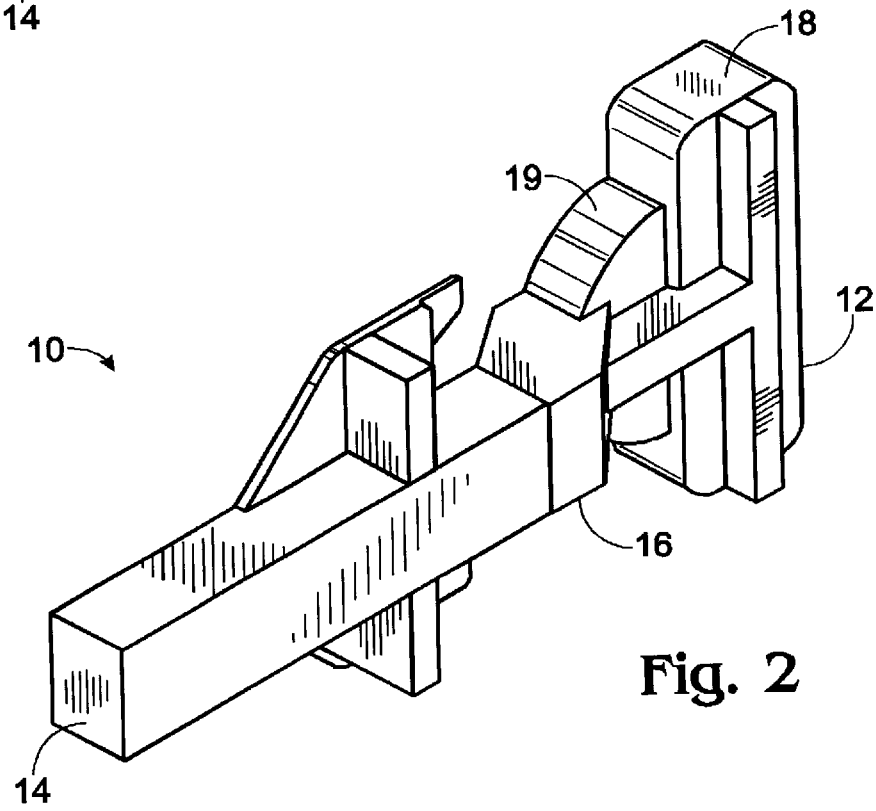
Fig. 2

HINGE COVER

CROSS REFERENCE TO RELATED APPLICATIONS

This application is a continuation in-part of U.S. application Ser. No. 09/745,596, filed on Dec. 21, 2000 now U.S. Pat. No. 6,557,210. The priority of the prior application is expressly claimed and its disclosure is hereby incorporated by reference in its entirety.

BACKGROUND OF THE INVENTION

This invention is related to the finishing of cabinetry and fine furniture, and more particularly to an improved device for masking hinges used in attaching doors to cabinets.

Cabinet making is an old and highly refined art. When building a new home or remodeling an old home, cabinets in the kitchen, dining room, living room and elsewhere are among the most expensive components of the home. In addition they are among the most visible and contribute a great deal to the overall appearance to the finished home. Cabinets are not merely ornamental. Kitchen cabinets in particular are used many times each day by members of the family. As a result, customers expect and demand very high levels of workmanship in the finished cabinets. These high levels of workmanship are expected in the fit of the cabinets, and in the finish of the cabinet. A highly visible indicator of quality in a finished cabinet, and therefore customer satisfaction, is the lack of overspray of the finish. It is essential that stain and or clear finish materials be applied properly to the appropriate surfaces, and that there be no overspray of either stain or clear finishing material on unintended parts or areas of the cabinet. In order to avoid overspray, before a finish is applied the cabinetmaker takes great pains to mask areas or components which are not to be finished. The masking of those components and areas of the cabinet not to be finished represents a significant expenditure of labor in the cabinet making process. Before the final finishing of the cabinet, the hinge is mounted to the door and the door is mounted in position on the cabinet. The door is then opened, the hinge is masked, and the interior of the cabinet is sprayed with a finish material. The masking of the hinge before spraying on the finish material is somewhat troublesome. Masking tape and paper must be applied carefully to the hinge to precisely cover it to its edges without extending onto the surface of the cabinet. The masking is complicated by the fact that the hinge does permit the door to move which can both make the masking more difficult, and disturb the masking material on the hinge, exposing parts of the hinge to finish overspray.

An alternative method is to apply the finish coating to the cabinet and door before assembly. This method necessarily results in additional handling of the components, reducing efficiency in the manufacturing process. In particular, applying finish to the door is particularly troublesome since only one side of the door can be finished at a time, or else the door must be mounted on a temporary jig. Attaching the hardware to the finished pieces can also mar the finished surface. A need remains therefore a way of quickly and effectively masking the hinges during the finishing of the cabinet.

BRIEF DESCRIPTION OF THE DRAWINGS

FIG. 1 is a perspective view of a first embodiment of a hinge cover according to the invention showing the first and second members in position over the hinge.

FIG. 2 is a perspective view of a hinge cover shown in FIG. 1 showing the first and second members in position on the hinge.

DETAILED DESCRIPTION

Figure 3:
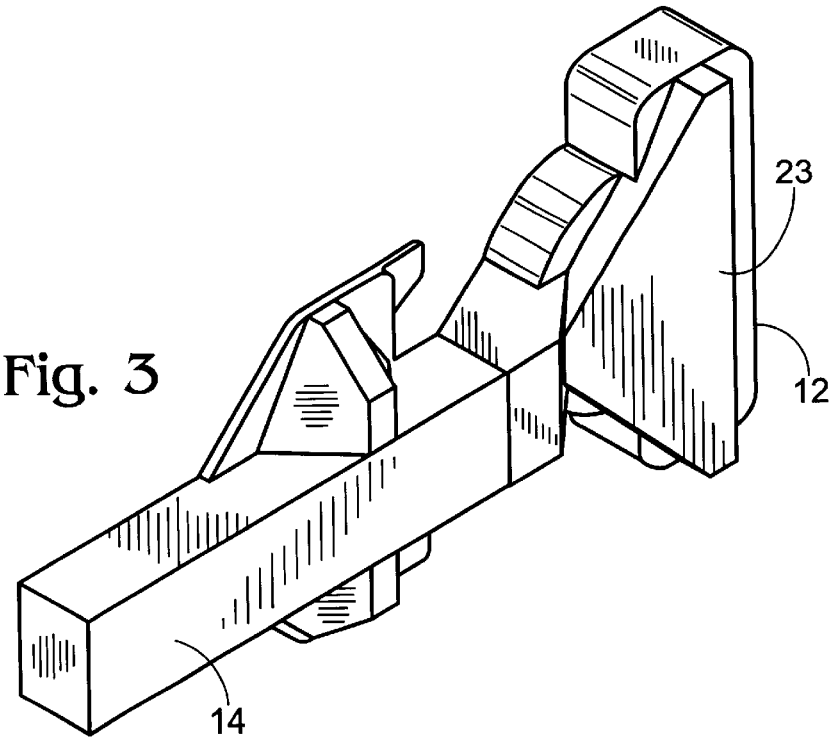
FIG. 3 is a perspective view of a second embodiment of a hinge cover according to the invention incorporating an alternative reinforcing member.
Figure 4:
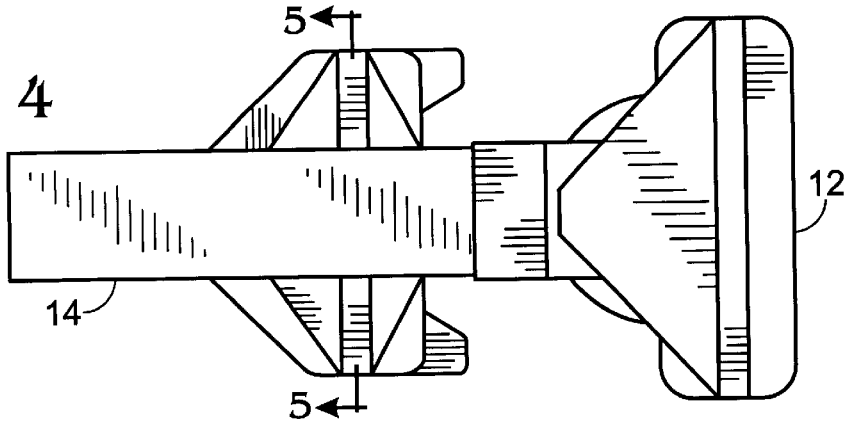
FIG. 4 is a top plan view of the hinge cover shown in FIG. 3.
Figure 6:
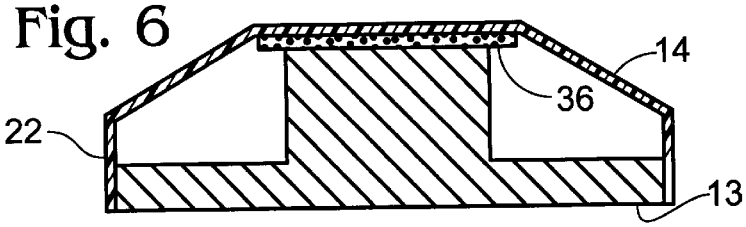
FIG. 6 is a cross-sectional view along line 5—5 of FIG. 4 showing an adhesive inserted between the hinge and the hinge cover.
Figure 7:
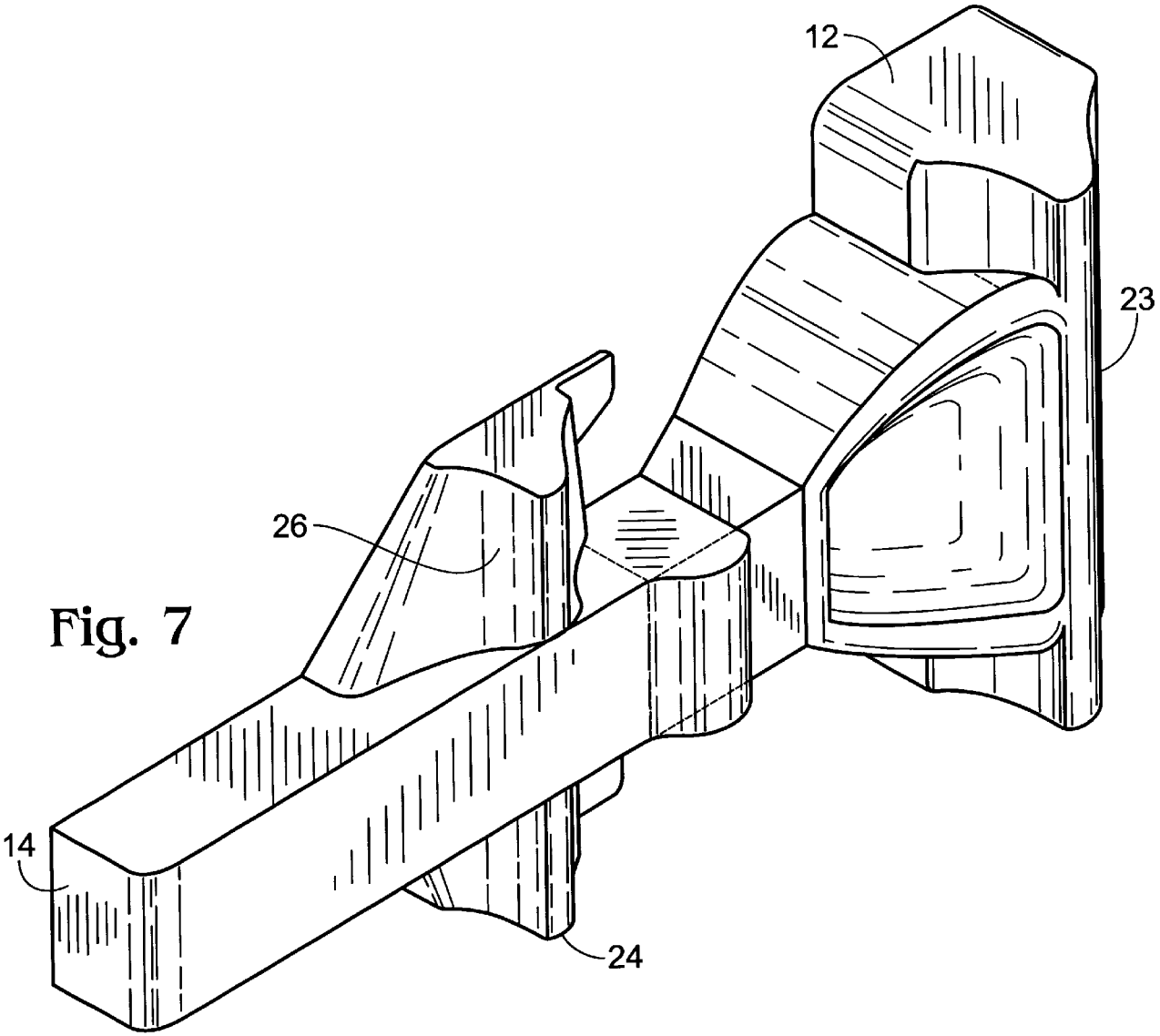
FIG. 7 is a perspective view of a third embodiment of the invention, wherein the reinforcing members are rounded to facilitate release from a mold.
Figure 8:
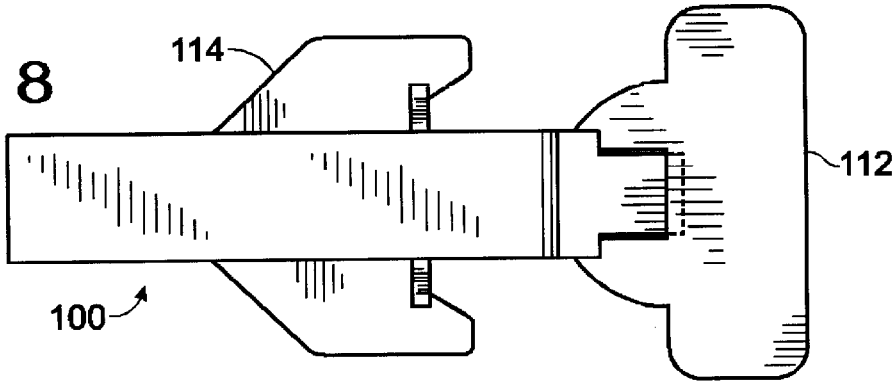
FIG. 8 is a top plan view of a second embodiment of the invention.
Figure 9:
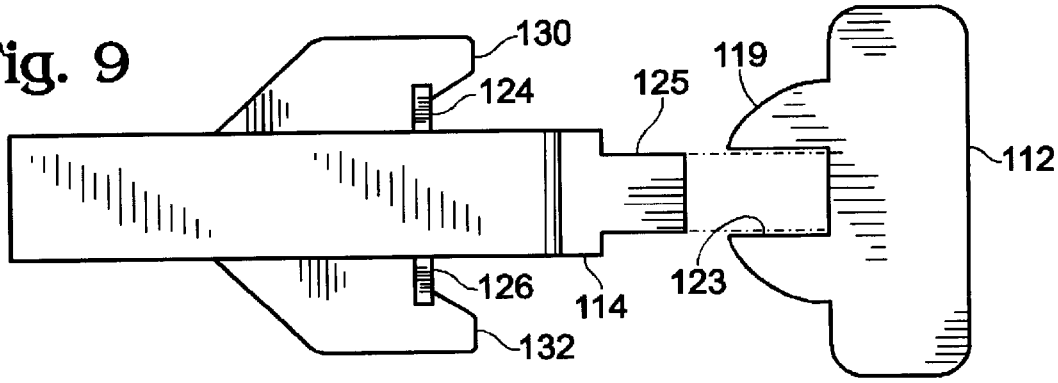
FIG. 9 is an exploded top view of the embodiment shown in FIG. 8.

Turning now to FIGS. 1–3, the invention is embodied in a hinge cover 10 having a first member 12 and a second member 14. The first member 12 is provided to cover that portion 11 of the hinge that is mounted in the door. Member 12 includes a top surface 16 and a downwardly extending flange 18. Top surface 16 is shaped and sized to closely cover the hinge portion 11. Flange 18 projects downwardly from surface 16 and is sized to terminate at the lower edge of the hinge sidewall 21. In one preferred embodiment, flange 18 includes a rounded portion 19 to cover and protect the rounded portion of hinge portion 11. Flange 18 is preferably formed of a resilient thermoplastic material, which is angled slightly inwardly so that when the hinge cover is applied, flange 18 exerts a gripping force on the hinge portion 11 to hold the cover in place. This aspect of the invention is of particular value since the cover will resist being lifted off of the hinge by the pressurized spray of stain or other finish applied to the cabinet. Member 12 can also be retained on hinge portion 11 by an adhesive, such as a double-sided adhesive tape 36, as shown in FIG. 6. Member 12 is reinforced by a raised T-shaped reinforcing portion 23 on top surface 16. In an alternative embodiment shown in FIG. 3, the reinforcing member is generally triangular. In another embodiment shown in FIG. 7, the reinforcing member 23 is more rounded to facilitate release of the finished hinge cover from the mold during manufacture. In each of the embodiments shown, reinforcing portion 23 resists longitudinal and lateral bending of the hinge cover, while allowing the hinge cover to be economically manufactured with relatively thin walls.

Figure 5:
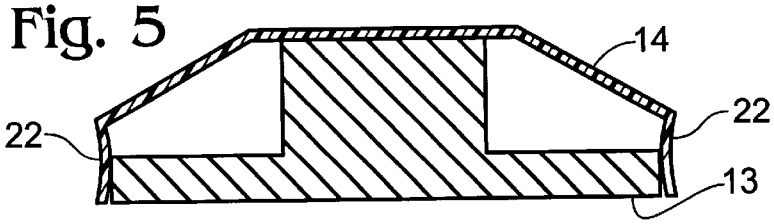
FIG. 5 is a cross-sectional view along line 5—5 of FIG. 4.

Referring again to FIG. 1 and FIG. 2, the second member 14 of the hinge cover is shaped to cover the portion 13 of the hinge that mounts on the face or sidewall of the cabinet. Member 14 includes a top wall 20 that is shaped and sized to closely conform to the shape of hinge portion 13 that is mounted on the wall of the cabinet. Flange 22 extends downwardly from top wall 20 to cover the sidewalls of the hinge adjacent to the surface of the cabinet. Flange 22 is preferably formed of a resilient material and is angled slightly inwardly so that when installed on the hinge, flange 22 exerts a gripping force to hold the cover in place. (FIG. 5) As with member 12, this aspect of the invention is of particular value since the cover will resist being lifted off of the hinge by the pressurized spray of stain or other finish applied to the cabinet. Member 14 is reinforced by a raised lateral reinforcing members 24 and 26 that connect top surface 20 to lateral flange covers 30 and 32 respectively. In the embodiment shown in FIG. 7, reinforcing members 24 and 26 are rounded to facilitate release of the finished hinge cover from the mold during manufacture.

The hinge cover just described alleviates most problems associated with the masking of hinges during the finishing of the cabinets. The cover as described, however, has an additional feature or benefit that alleviates another source of overspray during the finishing process. Recall that in the prior art masking techniques, the hinge is covered, but is still free to move. The moving of the hinge can sometimes expose portions of the hinge to overspray by causing the masking material to pull away from the hinge surface. In the hinge cover of the present invention, cover 10 includes a portion 25 that is sized to closely fit over the end portion 20*a* of top surface 20 of member 14. At the same time, portion 25 will pivot relative to the end portion 20*a* of top surface 20 to permit the door to be moved to some extent during finishing without lifting the hinge cover from either portion of the hinge itself. In this way, the hinge cover according to this invention solves a major shortcoming of the prior art, and represents a significant step forward.

Referring to FIGS. 8–13, a second preferred embodiment is shown, and differs primarily in the manner in which the two portions of the hinge cover interconnect. The second embodiment of the invention is shown at 100, which includes first and second members 112 and 114. The first portion 112 is provided to cover that portion 11 of the hinge that is mounted in the door. Member 112 includes a top surface 116 and a downwardly extending flange 118. Top surface 116 is shaped and sized to closely cover the hinge portion 11. Flange 118 projects downwardly from top surface 11, and is sized to terminate at the lower edge of the hinge sidewall 21. In one preferred embodiment, flange 118 includes a rounded portion 119 to cover and protect the rounded portion of hinge portion 11. Flange 118 is preferably formed of a resilient thermoplastic material, which is angled slightly inwardly so that when the hinge cover is applied, flange 118 exerts a gripping force on the hinge portion 11 to hold the cover in place. This aspect of the invention is of particular value since the cover will resist being lifted off of the hinge by the pressurized spray of stain or other finish applied to the cabinet. Member 112 can also be retained on hinge portion 11 by an adhesive, such as a double-sided adhesive tape 36, as shown in FIG. 6.

Figure 10:
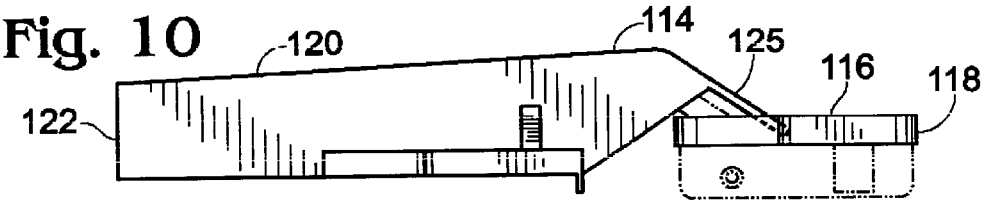
FIG. 10 is a side elevational view of the embodiment shown in FIG. 8.
Figure 11:
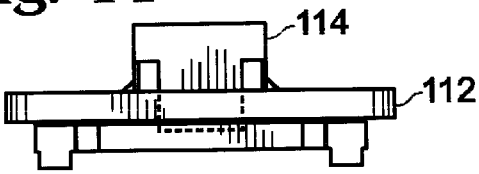
FIG. 11 is a front elevational view of the embodiment shown in FIG. 8.
Figure 12:
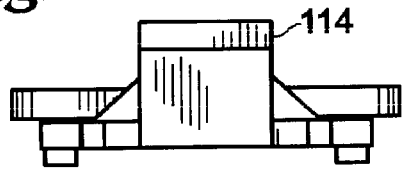
FIG. 12 is a rear elevational view of the embodiment shown in FIG. 8.
Figure 13:
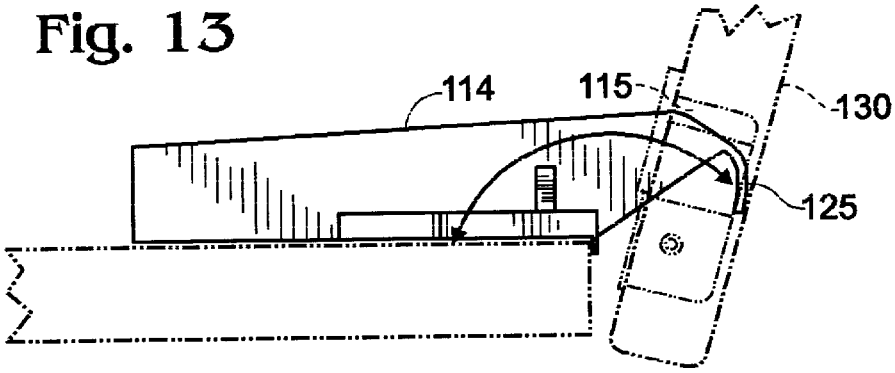
FIG. 13 is a side elevational view of the embodiment shown in FIG. 8, and showing the hinge cover in place on a door that is partially opened.

As in the first embodiment, the second portion 114 of the hinge cover is shaped to cover the portion of the hinge that mounts on the face or sidewall of the cabinet. Flange 122 extends downwardly from top wall 120 to cover the sidewalls of the hinge adjacent to the surface of the cabinet. Flange 122 is preferably formed of a resilient material and is angled slightly inwardly so that when installed on the hinge, flange 122 exerts a gripping force to hold the cover in place. (FIG. 5) As with member 112, this aspect of the invention is of particular value since the cover will resist being lifted off of the hinge by the pressurized spray of stain or other finish applied to the cabinet. Member 114 is reinforced by a raised lateral reinforcing members 124 and 126 that connect top surface 120 to lateral flange covers 130 and 132 respectively. Portion 112 includes a recess 123 in top wall 120 that is shaped and sized to closely receive a protruding portion 125 of portion 114. As best seen in FIG. 10, the opening 123 in member 112 is filled with protruding portion 125 of member 114 when both portions are in place on the respective hinge portions, and when the door is in the open position. In this position, the entire underlying hinge is covered and protected. Referring to FIG. 11, this embodiment of the invention includes the additional advantage of permitting the door 130 to be positioned in a partially closed position (for drying for example). After spraying, member 112 is removed, and the protruding portion 125 of member 114 is inserted into the recess of hinge portion 11, that is mounted on the cabinet door. Protruding portion 125 engages the limiting the travel of the hinge, and supporting the hinge in the partially opened position. This feature of the invention permits the interior of the cabinet to dry.

A hinge cover according to the invention is preferably made of a formable thermoplastic material. A hinge cover can be formed by any suitable technique, including vacuum forming or injection molding and the like. Those of ordinary skill in the art will appreciate that numerous changes in detail and arrangement can be made without departing from the scope of the following claims.

What is claimed is:

1. A hinge cover for covering a hinge, the hinge having a first portion for mounting on a fixed surface and a second portion for mounting on a door, the second portion hingedly attached to the first portion, the hinge having a first position wherein the first and second portions are perpendicular to one another, and a second position wherein the first and second portions are parallel to one another, the hinge cover comprising:

a first member having a raised channel with a protruding tongue portion, first left and right flanges, and at least one first vertical engaging surface for resiliently engaging at least one first vertical surface of the first hinge portion and sealingly engaging the at least one first vertical surface at a distal edge thereof;

a second member having a second raised channel, second left and right flanges, and at least one second vertical engaging surface for resiliently engaging at least one second vertical surface of the second hinge portion and sealingly engaging the at least one second vertical surface at a distal edge thereof; and the second raised channel including surfaces defining a recess for slidingly receiving the tongue of the first member.

2. A hinge cover according to claim 1 wherein the second member further comprises left and right reinforcing portions connecting the raised channel and the respective second left and right flanges.

3. A hinge cover according to claim 1 that further comprises at least one reinforcing member connected to at least one of the respective first left and right flanges.

4. A hinge cover according to claim 1 that is formed of a thermoplastic material.

5. A hinge cover according to claim 1 that is formed by vacuum forming.

6. A hinge cover according to claim 1 that is formed by injection molding.

7. A hinge cover according to claim 1 further comprising the reinforcing member having an upper surface that is generally T-shaped.

8. A hinge cover according to claim 1 further comprising the reinforcing member having an upper surface that is generally triangular.

9. A hinge cover according to claim 1 wherein the tongue engages the recess in a position to position the first and second members at an angle relative to one another that is between 0 and 90 degrees.

* * * * *